US012623108B2

(12) United States Patent
Noble et al.

(10) Patent No.: US 12,623,108 B2
(45) Date of Patent: May 12, 2026

(54) PORTABLE ELEVATED PUSHUP AND ARM CURL EXERCISE DEVICE

(71) Applicants: Donald Noble, Sarasota, FL (US); David E. Noble, Flower Mound, TX (US)

(72) Inventors: Donald Noble, Sarasota, FL (US); David E. Noble, Flower Mound, TX (US)

( * ) Notice: Subject to any disclaimer, the term of this patent is extended or adjusted under 35 U.S.C. 154(b) by 71 days.

(21) Appl. No.: 18/939,118

(22) Filed: Nov. 6, 2024

(65) Prior Publication Data

US 2026/0124484 A1 May 7, 2026

(51) Int. Cl.

| | |
|---|---|
| ***A63B 21/00*** | (2006.01) |
| ***A63B 21/04*** | (2006.01) |
| ***A63B 21/045*** | (2006.01) |
| ***A63B 23/035*** | (2006.01) |
| ***A63B 23/12*** | (2006.01) |

(52) U.S. Cl.

CPC .... *A63B 21/00069* (2013.01); *A63B 21/0407* (2013.01); *A63B 21/045* (2013.01); *A63B 21/4035* (2015.10); *A63B 23/03525* (2013.01); *A63B 23/1236* (2013.01); *A63B 23/1281* (2013.01); *A63B 2210/58* (2013.01); *A63B 2225/093* (2013.01)

(58) Field of Classification Search

CPC ..... A63B 21/00069; A63B 21/0407; A63B 21/045; A63B 21/4035; A63B 23/03525; A63B 23/1236; A63B 23/1281; A63B 2210/58; A63B 2225/093; A63B 22/00; A63B 22/0002; A63B 22/0005; A63B 22/0007; A63B 22/001; A63B 22/0076; A63B 22/0012

USPC ..... 482/92

See application file for complete search history.

(56) References Cited

U.S. PATENT DOCUMENTS

| | | | | | |
|---|---|---|---|---|---|
| 1,548,849 | A * | 8/1925 | Ruden | A63B 21/05 | 482/135 |
| 2,223,309 | A * | 11/1940 | Swanson | A63B 21/00072 | 482/123 |
| 3,228,392 | A * | 1/1966 | Speyer | A61H 23/06 | 601/134 |
| 5,421,800 | A * | 6/1995 | Mullen | A63B 21/00181 | 482/141 |
| 5,954,622 | A * | 9/1999 | Olschansky | A63B 21/4011 | 482/133 |
| 6,206,811 | B1 * | 3/2001 | Lat | A63B 21/00043 | 482/121 |

(Continued)

*Primary Examiner* — Andrew S Lo

(74) *Attorney, Agent, or Firm* — BELMONT LAW PLLC

(57) ABSTRACT

A portable exercise device allows a user to perform elevated pushups and/or arm curl exercises. A base has an opening defining a footrest. First and second arms are each extendable between a first position at least partially contained within the base and a second position at least partially extended from the base. A handle is supported by the first and second arms. A releasable locking mechanism is configured for releasably locking the first and second arms in one or more predefined or user-selected positions. A tension coil contained within the base is connected to the handle by first and second cables extending through the first and second arms, respectively. A dial connected to the tension coil allows user adjustment of resistance.

14 Claims, 4 Drawing Sheets

(56) References Cited

U.S. PATENT DOCUMENTS

| | | | | |
|---|---|---|---|---|
| 7,569,003 | B1 * | 8/2009 | Huffman | A63B 21/4045 482/111 |
| 7,896,786 | B1 | 3/2011 | Osbourne | |
| 8,092,354 | B2 * | 1/2012 | Oller, Jr. | A63B 21/4047 482/131 |
| 8,348,814 | B1 | 1/2013 | Hinds et al. | |
| 9,205,297 | B2 * | 12/2015 | Kaehler | A63B 23/0355 |
| 10,413,771 | B1 * | 9/2019 | Del Conte | A63B 23/03516 |
| 10,471,293 | B2 | 11/2019 | George | |
| 2002/0098959 | A1 | 7/2002 | Florek | |
| 2008/0090706 | A1 * | 4/2008 | Boland | A63B 23/0211 482/122 |
| 2013/0005542 | A1 * | 1/2013 | Wu | A63B 21/00069 482/128 |
| 2013/0316882 | A1 * | 11/2013 | Param | A63B 21/055 482/125 |
| 2014/0011646 | A1 * | 1/2014 | Wu | A63B 23/12 482/122 |
| 2015/0375031 | A1 * | 12/2015 | Tong | A63B 21/023 482/128 |
| 2016/0228740 | A1 * | 8/2016 | Castelluccio | A63B 23/0211 |
| 2020/0001128 | A1 * | 1/2020 | Hume | A47C 9/002 |
| 2021/0178217 | A1 | 6/2021 | Ix et al. | |
| 2023/0347197 | A1 | 11/2023 | Acri | |

* cited by examiner

PORTABLE ELEVATED PUSHUP AND ARM CURL EXERCISE DEVICE

SUMMARY

According to one aspect, a portable exercise device comprises a base having an opening defining a footrest, and first and second arms each being extendable between a first position at least partially contained within the base and a second position at least partially extended from the base. A handle is supported by the first and second arms. A releasable locking mechanism is provided for releasably locking the first and second arms in one or more predefined and/or user-selected positions. An adjustable tension coil contained within the base is connected to the handle via first and second cables extending through the first and second arms, respectively. A dial connected to the adjustable tension coil enables adjustment of tension on the coil, thereby adjusting resistance against movement of the handle.

In some aspects, the handle may have a first handgrip supported by the first arm and a second handgrip supported by the second arm. In some examples, the first handgrip and the second handgrip may be releasably attached to each other.

In some aspects, the releasable locking mechanism may have a first locking mechanism for releasably locking the first arm and a second locking mechanism for releasably locking the second arm. The locking mechanism(s) may be provided on the base or on the handle.

The exercise device described herein is compact, easy-to-use and easy-to-transport and store. When the locking mechanism is engaged, the device may be used as a platform for performing elevated pushups. The user may adjust the height of the handle to achieve a desired range of motion. The handle height may be set at any position ranging from the first and second arms being in a fully extended position to being in a fully retracted position. The user may then simply grasp the handle and perform pushups.

When the locking mechanism is released, the device may be used for performing arm curl exercises. The user may select a desired amount of resistance by adjusting the resistance dial, and then grasp the handle and raise and lower it to exercise his or her arms. Different muscle groups may be targeted by altering the grip, e.g., palms-up for exercising biceps, palms-down for exercising triceps, and so forth. The user may place one or both feet in the footrest area of the base to assist with securing the device in place during arm curl exercises.

DETAILED DESCRIPTION

Figure 1:
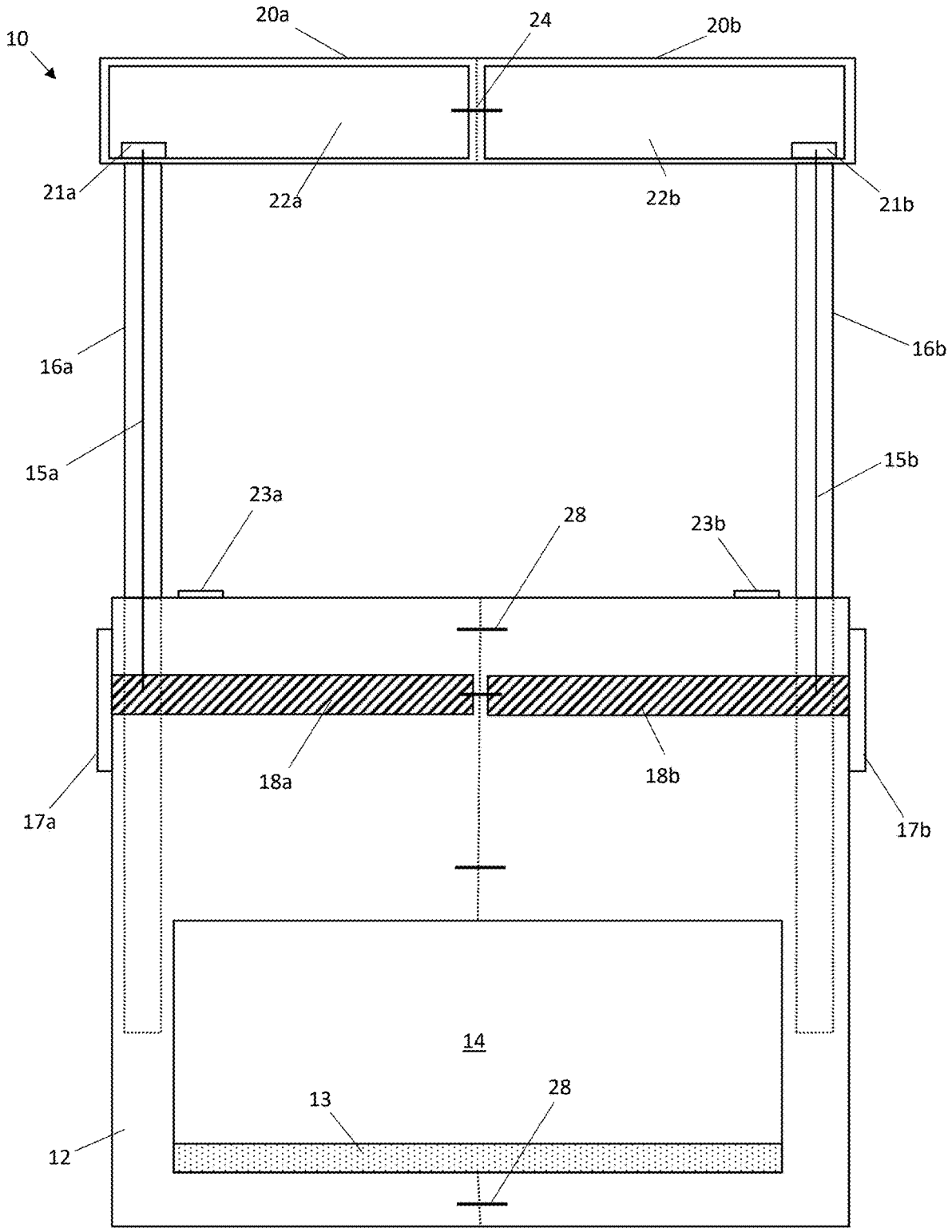
FIG. 1 is a schematic illustration of an exercise device in accordance with one or more aspects, with the extendable arms in a fully extended position.

With reference to FIG. 1, a portable exercise device 10 has a base 12 featuring an open area 14 at a lower portion thereof to provide user access to an optionally padded footrest 13.

In some aspects, the user may place one or both feet on the footrest 13 to use his or her own body as a counterweight when performing arm curl exercises. The device may be constructed of any material that provides sufficient strength and rigidity for its intended uses as described herein. Non-limiting examples of materials that may be used for construction include metals, resins, and composite materials.

The exercise device 10 depicted in FIG. 1 has first and second handles 20*a* and 20*b* which may feature comfortable (e.g., non-slip) grip surfaces for a user to grasp while performing elevated pushups or arm curl exercises, as described herein. The base 12 may contain adjustable tension coils 18*a* and 18*b* connected to the handles 20*a* and 20*b* via first and second cables 15*a* and 15*b* to provide a desired resistance for performing arm curl exercises. The handles 20*a* and 20*b* may contain internal cylinders 22*a* and 22*b* constructed of metal or other sturdy material to increase strength and dimensional stability. The cables 15*a* and 15*b* may be secured to the cylinders 22*a* and 22*b* using suitable fasteners 21*a* and 21*b*, respectively.

Figure 2:
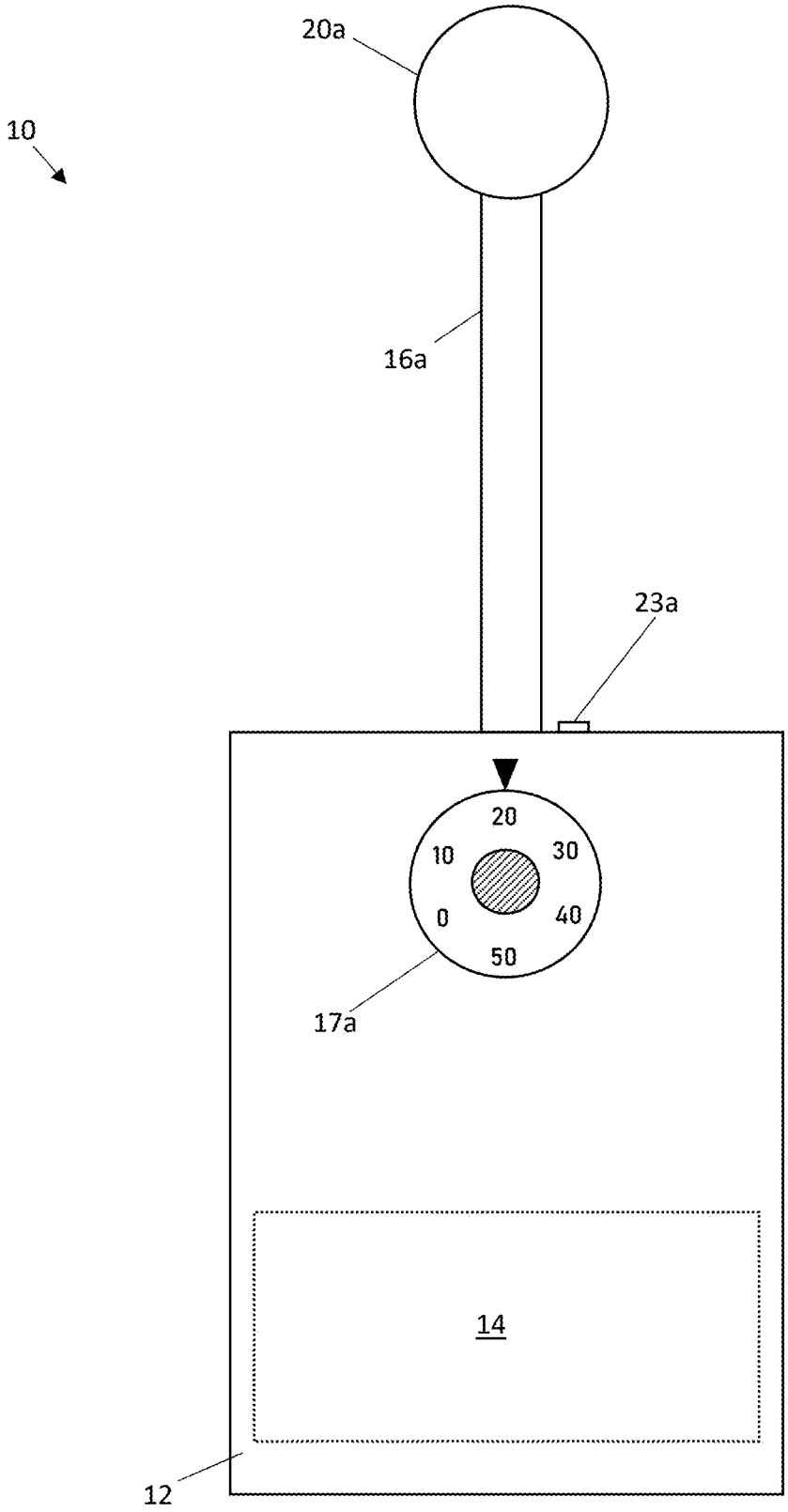
FIG. 2 is side elevation view of the exercise device of FIG. 1.

The tension on the coils 18*a* and 18*b* may be adjusted to provide desired resistance for arm curl exercises. For example, rotatable dials 17*a* and 17*b* may be used to increase or decrease tension on the coils 18*a* and 18*b*, respectively. As shown in FIG. 2, the dial 17*a* may contain indicia to allow the user to adjust resistance corresponding to a specific weight, e.g., 10-50 lbs.

Figure 3:
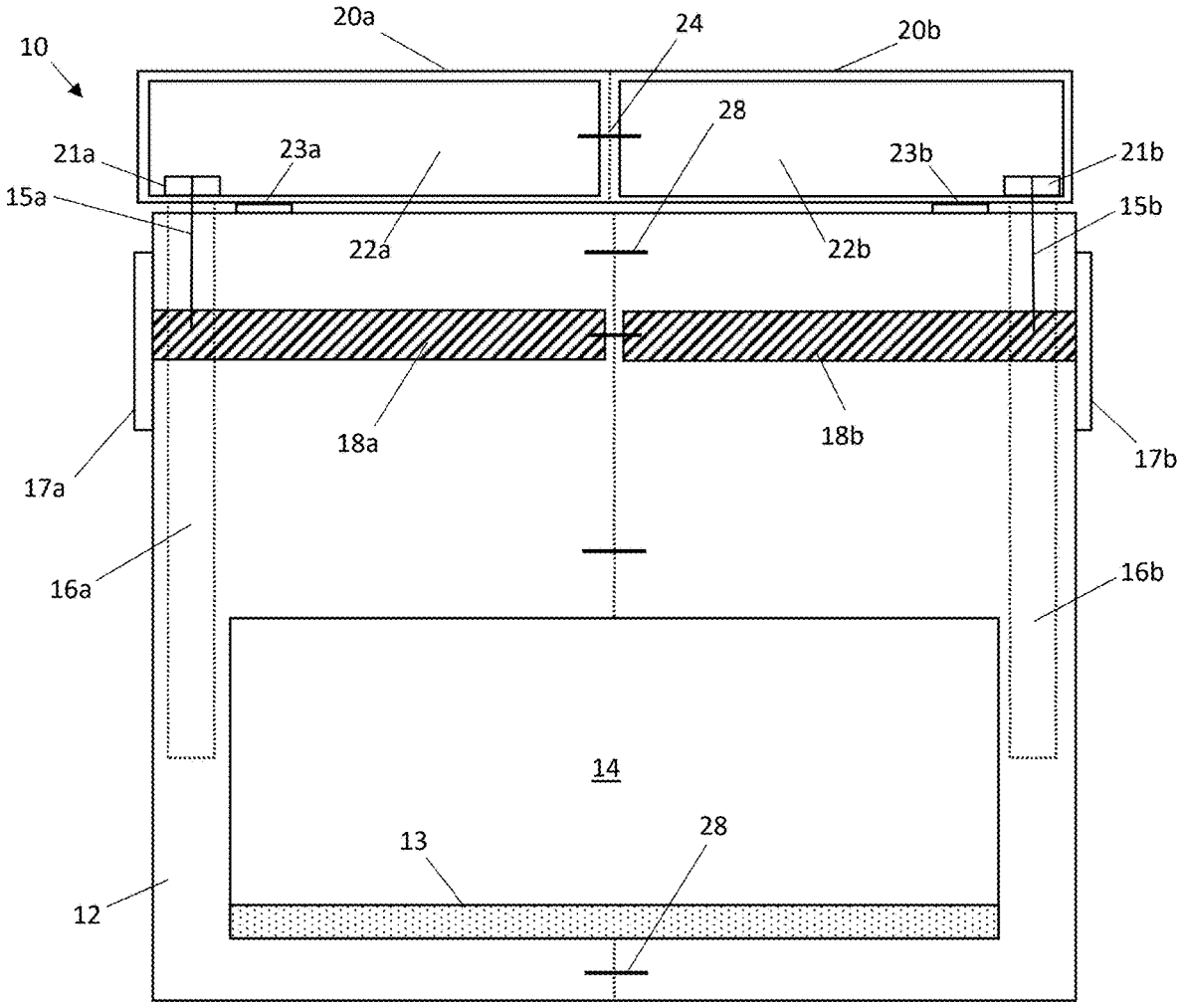
FIG. 3 is a schematic illustration of the exercise device of FIG. 1 with the extendable arms in a fully retracted position.
Figure 4:
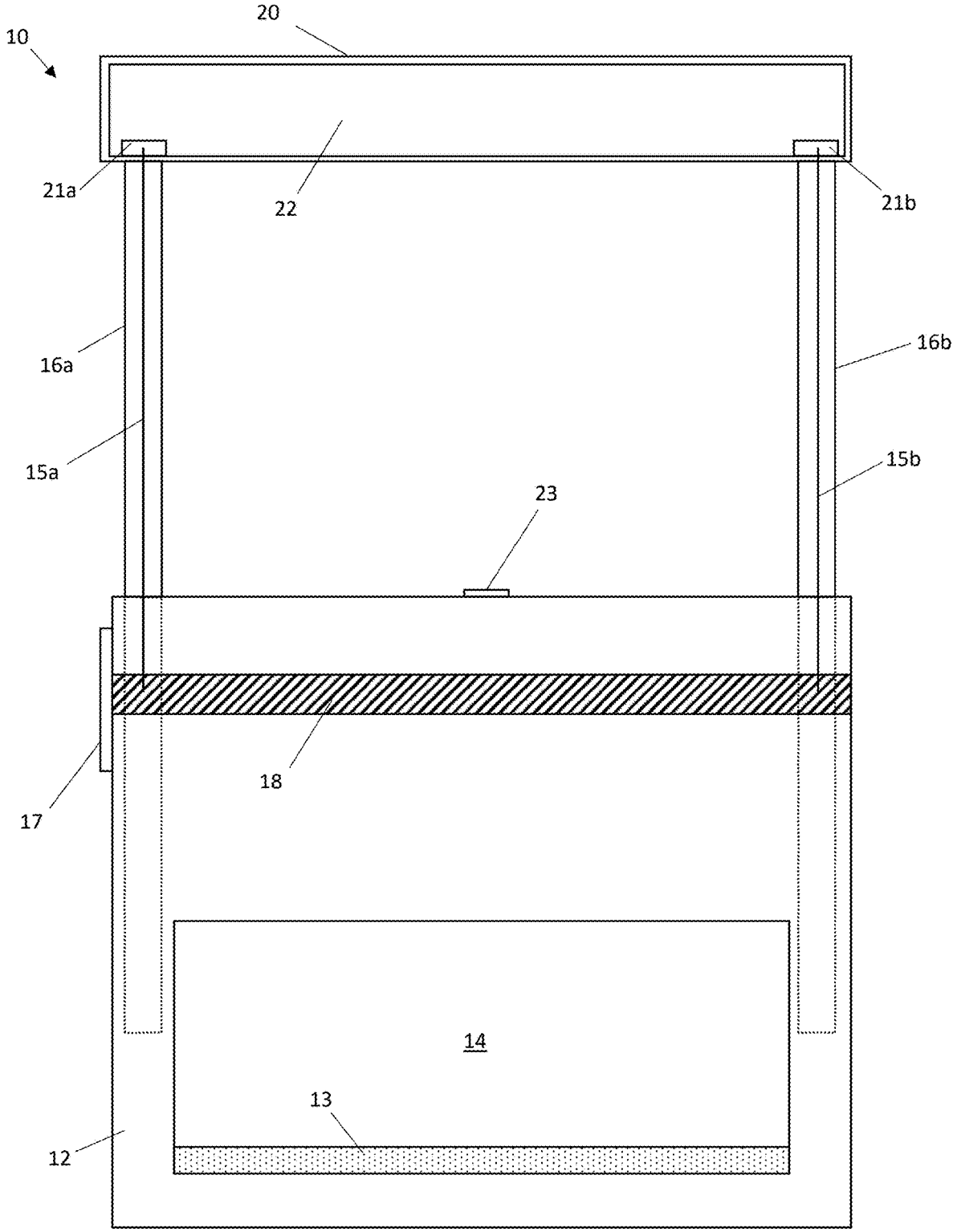
FIG. 4 is a schematic illustration of an exercise device in accordance with another embodiment.

The base 12 is configured for receiving first and second retractable arms 16*a* and 16*b*, respectively, as illustrated by the dotted lines shown in FIGS. 1, 3 and 4. First and second releasable locking mechanisms include first and second actuators 23*a* and 23*b* for locking the retractable arms 16*a* and 16*b*, respectively. In one example, the releasable locking mechanisms are configured such that, when engaged, the arms 16*a* and 16*b* are locked at a user-selected position for adjusting the height of the handles 20*a* and 20*b*. In another example, the releasable locking mechanisms are configured such that, when engaged, the arms 16*a* and 16*b* are locked upon reaching either the fully extended position (see FIGS. 1, 2 and 4) or the fully retracted position (see FIG. 3). The arms 16*a* and 16*b* may be locked in the fully retracted position to facilitate transport and storage, for example, and at the fully extended position or another desired position for performing elevated pushups, for example. The releasable locking mechanisms may be released to allow free extension and retraction of the arms 16*a* and 16*b* when performing arm curl exercises. The first and second actuators 23*a* and 23*b* may be placed at any suitable position, such as along the base 12, as shown in FIG. 1, or along the handles 20*a* and 20*b*.

As depicted in FIG. 1, the handles 20*a* and 20*b* may be detachable from each other to allow alternating arm curl exercises, for example. Optionally, an engaging member 24 may be provided to releasably secure the handles 20*a* and 20*b* to each other so that they move together during extension and retraction of the arms 16*a* and 16*b*. The base 12 likewise may be divided into first and second adjoining segments with suitable engaging members 28, as shown in FIG. 1. The segments may be separated to allow compaction of the device for transport and storage, for example.

FIG. 4 shows an alternative embodiment featuring a simplified construction with an integral handle 20 with a single internal cylinder 22; and an integral base 12 contains a single tension coil 18 and tension adjustment dial 17. First and second releasable locking mechanisms 23*a* and 23*b* may be provided for locking the retractable arms 16*a* and 16*b*, as shown in FIG. 1, or alternatively a single locking mechanism 23 may be provided for simultaneously locking both retractable arms 16*a* and 16*b*, as shown in FIG. 4. The exercise device 10 shown in FIG. 4 may operate in essentially the same manner as described above with the exception of allowing independent movement of the left- and right-hand handgrips due to the integral construction of the handle 20.

While the invention has been described with respect to specific examples, those skilled in the art will appreciate that there are numerous variations and permutations of the above described systems and techniques that fall within the spirit and scope of the invention as set forth in the appended claims.

What is claimed is:

1. A portable exercise device comprising:

i. a base having an opening defining a footrest;

ii. first and second arms, each being extendable between a first position at least partially contained within the base and a second position at least partially extended from the base;

iii. a handle supported by the first and second arms;

iv. a releasable locking mechanism for releasably locking the first and second arms in one or more predefined or user-selected positions;

v. an adjustable tension coil contained within the base and connected to the handle by first and second cable segments extending through the first and second arms, respectively; and vi. a dial connected to the adjustable tension coil for adjusting a tension thereof.

2. The portable exercise device of claim 1, wherein the handle comprises a first handgrip supported by the first arm and a second handgrip supported by the second arm.

3. The portable exercise device of claim 2, wherein the first handgrip and the second handgrip are releasably attachable to each other.

4. The portable exercise device of claim 1, wherein the releasable locking mechanism comprises a first locking mechanism for releasably locking the first arm and a second locking mechanism for releasably locking the second arm.

5. The portable exercise device of claim 1, wherein an actuator for the releasable locking mechanism is provided on the base.

6. The portable exercise device of claim 1, wherein an actuator for the releasable locking mechanism is provided on the handle.

7. The portable exercise device of claim 1, wherein the handle comprises an internal cylinder to which the first and second cable segments are secured.

8. The portable exercise device of claim 1, wherein the base is divided into first and second segments releasably attached to each other, wherein the first segment contains a first adjustable tension coil and the second segment contains a second adjustable tension coil.

9. A portable exercise device comprising:

i. a base having an opening defining a footrest;

ii. first and second arms, each being extendable between a first position at least partially contained within the base and a second position at least partially extended from the base;

iii. a handle comprising a first handgrip supported by the first arm and a second handgrip supported by the second arm, wherein the first handgrip and the second handgrip are releasably attachable to each other;

iv. a releasable locking mechanism for releasably locking the first and second arms in one or more predefined or user-selected positions;

v. an adjustable tension coil contained within the base and connected to the first and second handgrips by first and second cable segments extending through the first and second arms, respectively; and vi. a dial connected to the adjustable tension coil for adjusting a tension thereof.

10. The portable exercise device of claim 9, wherein the releasable locking mechanism comprises a first locking mechanism for releasably locking the first arm and a second locking mechanism for releasably locking the second arm.

11. The portable exercise device of claim 9, wherein an actuator for the releasable locking mechanism is provided on the base.

12. The portable exercise device of claim 9, wherein an actuator for the releasable locking mechanism is provided on the handle.

13. The portable exercise device of claim 9, wherein the first handgrip comprises a first internal cylinder to which the first cable segment is secured, and the second handgrip comprises a second internal cylinder to which the second cable segment is secured.

14. The portable exercise device of claim 9, wherein the base is divided into first and second segments releasably attached to each other, wherein the first segment contains a first adjustable tension coil and the second segment contains a second adjustable tension coil.

* * * * *